US010730024B2

(12) United States Patent
Miller et al.

(10) Patent No.: US 10,730,024 B2
(45) **Date of Patent: *Aug. 4, 2020**

(54) SYSTEM AND METHOD FOR MICRO DOSING

(71) Applicant: E. & J. Gallo Winery, Modesto, CA (US)

(72) Inventors: Jeff Miller, Ripon, CA (US); Leland Fleming, Modesto, CA (US); Lewis Stern, Modesto, CA (US); Satish Puran, Modesto, CA (US); Richard Branscombe, Escalon, CA (US)

(73) Assignee: E&J Gallo Winery, Modesto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/348,738

(22) Filed: Nov. 10, 2016

(65) Prior Publication Data

US 2017/0056847 A1 Mar. 2, 2017

Related U.S. Application Data

(60) Continuation-in-part of application No. 14/733,770, filed on Jun. 8, 2015, now Pat. No. 10,011,375, which is a division of application No. 13/594,675, filed on Aug. 24, 2012, now Pat. No. 9,440,205.

(51) Int. Cl.

| | |
|---|---|
| ***B67C 3/00*** | (2006.01) |
| ***B01F 5/10*** | (2006.01) |
| ***B01F 15/00*** | (2006.01) |
| ***F04B 43/12*** | (2006.01) |
| ***B67C 3/20*** | (2006.01) |
| *B01F 3/00* | (2006.01) |

(52) U.S. Cl.

CPC ..... *B01F 5/10* (2013.01); *B01F 15/00389* (2013.01); *B67C 3/208* (2013.01); *F04B 43/12* (2013.01); *B01F 2003/0028* (2013.01)

(58) Field of Classification Search

CPC ..... B67C 3/00
USPC ..... 366/136, 137, 159.1
See application file for complete search history.

(56) References Cited

U.S. PATENT DOCUMENTS

| | | | | |
|---|---|---|---|---|
| 2,915,023 A * | 12/1959 | Rapaport | A23G 1/305 118/13 |
| 6,544,109 B1 * | 4/2003 | Moore | B24B 37/04 451/285 |
| 10,011,375 B1 * | 7/2018 | Miller | B01F 5/104 |
| 2010/0224256 A1 * | 9/2010 | Tseng | B24B 37/04 137/2 |

* cited by examiner

*Primary Examiner* — David L Sorkin
(74) *Attorney, Agent, or Firm* — Goodwin Procter LLP

(57) ABSTRACT

A system and method of micro dosing containers on a conveying system is disclosed. The system includes a mixing tank to maintain suspended solids in a mixture; a dosing assembly to inject micro-doses of the mixture into bottles; a recirculation assembly to circulate the mixture from the supply tank to the dosing assembly and back to the supply tank; a power and controls operation assembly to supply the system with power, to provide the system with electromechanical control and/or to provide a user interface; and a stand to hold at least the supply tank, the portable dosing assembly, the recirculation assembly and/or the power and/or controls operation assembly.

10 Claims, 9 Drawing Sheets

SYSTEM AND METHOD FOR MICRO DOSING

CROSS REFERENCE TO RELATED APPLICATIONS

This application is a continuation-in-part of U.S. application Ser. No. 14/733,770, filed Jun. 8, 2015, which is a divisional of U.S. application Ser. No. 13/594,675, filed on Aug. 24, 2012, which are hereby incorporated by reference.

FIELD OF TECHNOLOGY

The present disclosure relates in general to systems and methods for micro dosing.

BACKGROUND

One prior colorant is based on a natural silicate known as mica combined with titanium dioxide. This creates a range of colors with metallic sheen, from silver to gold. Titanium dioxide coated mica powder (herein referred to as "colored mica") is easy to apply and is widely used for various food applications (e.g., the coating of jelly beans, gums, the decoration of chocolate, biscuits, ice-cream and beverages). Colored mica can be mixed with various liquids to create a shiny and shimmering finish to the liquid. This gives the beverage a distinctive look and creates great consumer appeal visually. However, colored mica contaminates the beverage process and bottle filling equipment as it is extremely difficult or impossible to remove. There are various existing attempts at solutions to try and overcome this problem which will be discussed below. However, none of the existing attempts have proven satisfactory as all have disadvantages that render them unsatisfactory.

One prior attempt at a solution is to use dedicated production equipment for liquids requiring colored mica and separate equipment for liquids that do not require colored mica. This avoids cross-product contamination due to residual suspended solids from beverages with colored mica. However, this requires additional equipment at an economically unfeasible cost. This also greatly underutilizes the equipment for both processes.

Another prior approach requires aggressive, invasive and expensive cleaning of production equipment between products that require colored mica and those that do not. However, this adds to cost and time to disassemble, clean and/or replace components such as seals and gaskets in processing and bottle filling equipment that have been contaminated.

Some manufacturers add mixture modifiers such as gum or sugar to hold the solid particles in suspension for bottle filling. This may eliminate some of the difficulty of cleaning the equipment since residual solids would be prevented from settling in the equipment. However, the addition of solution modifiers creates sanitation issues due to potential pests and microbes and may also create a less temperature-stable mixture. Furthermore, there is an additional cost involved in cleaning and operational complexity in removing these modifiers from the equipment. Further, once material like colored mica is introduced into a filling system, it is virtually impossible to remove.

Another attempt at a solution is to use recirculating filling systems that maintain fluid velocities at all times to prevent colored mica from settling in the equipment. However, these systems are expensive. Additionally, these systems may stop unexpectedly (e.g., due to power losses) that leads to colored mica settling and contaminating the process equipment.

Therefore, there is a pressing need for a system and method for addition of materials that are difficult to clean and/or clear from a filling system. The present system and method solves these problems with a micro dosing system and method. One of the advantages of micro dosing is to avoid the contamination of a primary filling or supply system.

The foregoing examples of the related art and limitations related therewith are intended to be illustrative and not exclusive. Other limitations of the related art will become apparent to those of skill in the art upon a reading of the specification and a study of the drawings.

SUMMARY

The following aspects and embodiments thereof described and illustrated below are meant to be exemplary and illustrative, not limiting in scope.

A system and method of micro dosing is disclosed. The system and method is particularly useful with bottling and conveying systems. The system includes a supply tank designed to keep suspended solids in a homogenous mixture; a portable dosing assembly to inject micro-doses of the mixture into pre-filled bottles or containers; a recirculation assembly to circulate the mixture from the supply tank to the portable dosing assembly and back to the supply tank; a power and controls operation assembly to supply the system with power, to provide the system with electromechanical control and to provide a user interface; and a portable or fixed stand to hold the supply tank, the portable dosing assembly, the recirculation assembly and the power and controls operation assembly.

In one embodiment, a micro-dosing system is contemplated. In a preferred embodiment, the micro dosing system is portable. The system includes a supply or mixing tank, a dosing assembly, a recirculation assembly, a power and/or control assembly, and a dosing stand. In an embodiment, the portable dosing assembly includes a dosing pump or servo doser to inject micro-doses of the micro dose blend into containers such as bottles pre-filled with a substance to which the micro dose is added.

In an embodiment, the recirculation assembly is fluidly coupled to the supply tank and the dosing assembly. In an embodiment, the recirculation assembly is configured to circulate the micro dose blend from the supply tank to the dosing assembly and/or back to the supply tank. In an embodiment, the recirculation assembly comprises a product pump, which may be a peristaltic pump, for drawing the dose blend from the supply tank and pumping the dose blend to the dosing assembly. In an embodiment, the product pump includes a variable-frequency drive motor for controlling the rotational speed of the peristaltic pump. In an embodiment, the recirculation assembly includes an umbilical bundle for fluid and/or wiring transport.

In an embodiment, the power and/or control operation assembly is configured to supply the system with power, to provide the system with an electromechanical control, and/or to provide a user interface. In an embodiment, the power and controls operation assembly includes a power supply. In an embodiment, the power and controls operation assembly includes a compact logic programmable logic controller for providing the system with electromechanical control. In an embodiment, the power and controls operation assembly includes a human-machine interface (HMI) control panel for providing a user interface. In one embodiment, the HMI control panel includes an operating and monitoring screen for user-controlled operation and monitoring.

In an embodiment, the umbilical bundle includes a dose supply tube fluidly coupled to the supply tank and the dosing assembly, for supplying the dose blend from the supply tank to the dosing assembly; a dose return tube fluidly coupled to the dosing assembly and the supply tank, for returning the mixture from the dosing assembly to the supply tank; and a bottle sensor cable for automating an electromechanical control of a bottle sensor photo eye.

In an embodiment, the dosing stand is configured to hold the supply tank, the dosing assembly, the recirculation assembly, and/or the power and controls operation assembly. In a further embodiment, the dosing stand is portable and comprises at least two wheels. In another embodiment, the dosing stand comprises at least two legs for securing the dosing stand in a working position. In yet another embodiment, the dosing stand comprises a hose rack for securing or holding an umbilical bundle, for example.

In an embodiment, the supply tank includes an agitator or mixer for mixing and/or blending the micro dose blend. Preferably, the agitator keeps the micro dose blend in a suspension. In another embodiment, the agitator includes a variable-frequency drive motor for controlling the rotational speed of the agitator. In a further embodiment, the supply tank includes a hinged lid for access to the supply tank, e.g., for adding the dose blend and/or cleaning. In one embodiment, the hinged lid includes at least three sealed ports having a discharge outlet, a return inlet, and a filtered vent.

In an embodiment, the dosing assembly includes a mobile stand for holding pre-filled bottles or containers. In another embodiment, the dosing pump is positioned on a support stand coupled to the dosing stand. In a further embodiment, the dosing pump further comprises a servo controller to inject the correct or desired amount of micro dose blend into the pre-filled bottles by controlling the position and/or speed of the dosing pump. In yet another embodiment, the dosing assembly includes a bottle sensor photo eye for detecting an opening of a pre-filled bottle.

In another embodiment, a method for micro-dosing individual bottles or containers is contemplated. In an embodiment, the method includes (i) mixing and/or blending a solid material in a liquid to form a homogenous suspension in a supply tank, (ii) circulating the suspension from the supply tank to a dosing assembly, (iii) injecting micro doses of the suspension into pre-filled bottles with a portable dosing, and (iv) circulating the suspension not injected back to the supply tank. In an embodiment, the method further includes agitating the homogeneous suspension in the supply tank. In another embodiment, the method further includes adjusting a flow of the suspension through the system to maintain the solid in suspension. In a further embodiment, the method includes detecting the presence of an opening of the pre-filled bottle prior to injecting the micro doses into pre-filled bottles or containers.

The above and other preferred features, including various novel details of implementation and combination of events, will now be more particularly described with reference to the accompanying figures and pointed out in the claims. It will be understood that the particular system and methods described herein are shown by way of illustration only and not as limitations. As will be understood by those skilled in the art that the principles and features described herein may be employed in various and numerous embodiments without departing from the scope of the invention. As can be appreciated from the foregoing and following description, each and every feature described herein, and each and every combination of two or more of such features, is included within the scope of the present disclosure provided that the features included in such a combination are not mutually inconsistent. In addition, any feature or combination of features may be specifically excluded from any embodiment of the present invention.

BRIEF DESCRIPTION OF THE DRAWINGS

The accompanying figures, which are included as part of the present specification, illustrate the presently preferred embodiments and together with the general description given above and the detailed description of the preferred embodiments given below serve to explain and teach the principles described herein.

DETAILED DESCRIPTION

Figure 1:
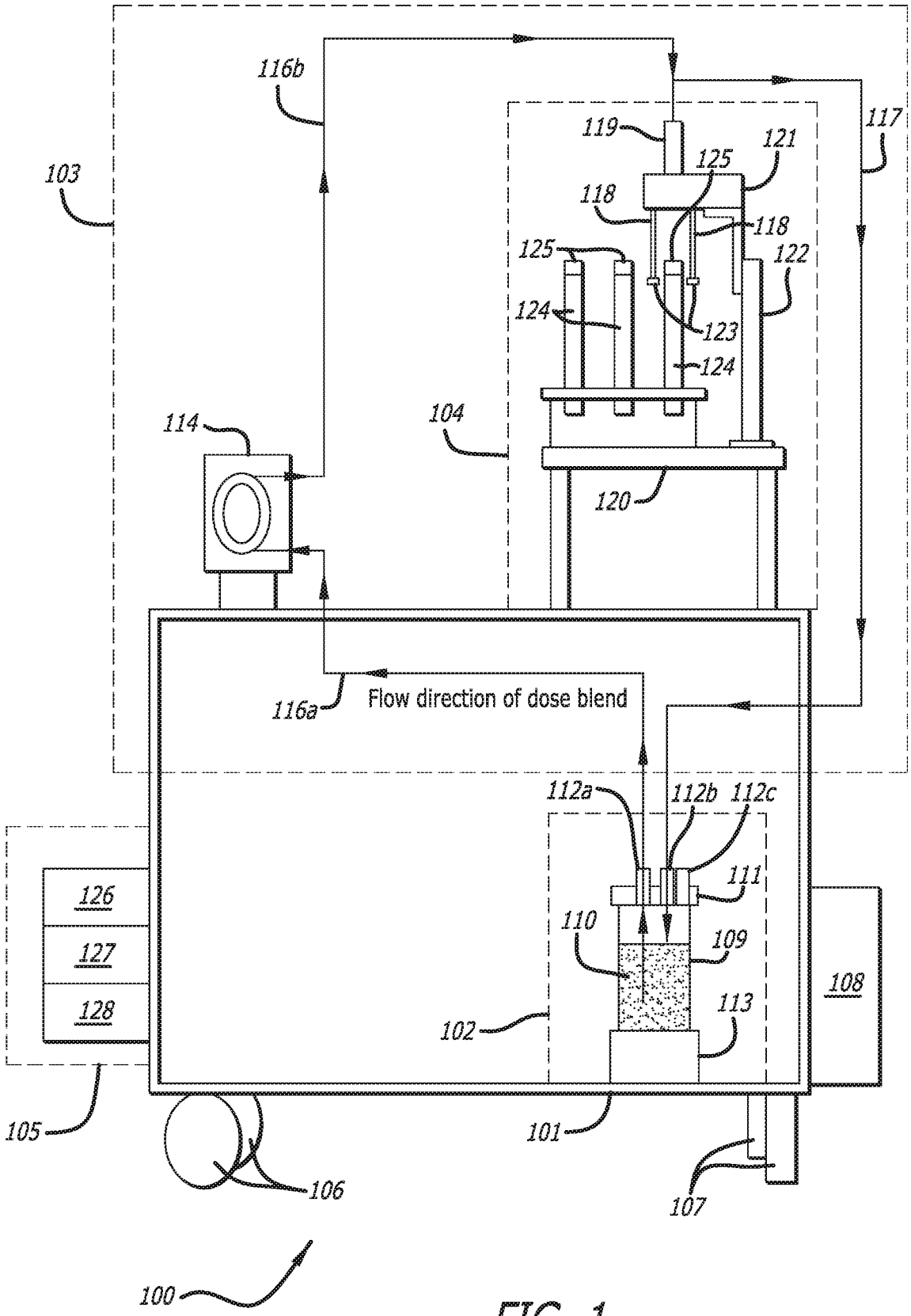
FIG. 1 illustrates a diagram of the micro bottle dosing system, according to one embodiment.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details.

Measurements, sizes, amounts, etc., are often presented herein in a range format. The description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as 10-20 inches should be considered to have specifically disclosed subranges such as 10-11 inches, 10-12 inches, 10-13 inches, 10-14 inches, 11-12 inches, 11-13 inches, etc.

FIG. 1 illustrates a diagram of the micro bottle dosing system 100, according to one embodiment. "Micro dosing" as used herein refers to the process of adding small quantities of a material to a system. In the context of a bottling system, micro dosing generally refers to addition of small quantities of a material during the bottling procedure. Typically, the micro dose is added to the container (e.g., a bottle) after the container is partially filled. The micro dose is typically a liquid or a mixture of liquid and solid. The system 100 generally interacts with a bottle conveying system. Typically, a dosing pump, such as a Hibar servo pump, and bottle sensor are positioned after a standard bottle filler, above a bottle transporting feed screw that is before the bottle closure machine (such as a cork inserter or screw capper). The dosing system includes a dosing stand 101, a mixing-blending-supply tank system 102, a recirculation system 103, a dosing assembly system 104, and a power controls operation system 105. The dosing stand 101 may be a stainless steel stand that is eighteen inches wide with a depth of eighteen inches and a height of sixty inches, according to one embodiment. It will be appreciated that the dosing stand 101 may be formed of any suitable material such as, but not limited to, metals and plastics. Suitable metals include, but are not limited to stainless steel, carbon steel or other steel alloys, and titanium. It will be appreciated that the dosing stand may be fabricated of more than one material. It will be further appreciated that the dosing stand 101 may be any size and shape suitable for interacting with a bottle conveying system as known in the art. Preferably, the stand is portable so that it may be used with alternate bottle conveying systems and/or at alternate sites. In this embodiment, the base of the dosing stand 101 includes at least two wheels 106 for tilting and rolling the dosing system 100 and two legs 107 for securing the stand in the working position. It will be appreciated that the dosing stand 101 may further be positioned on three, four or more wheels for portability. Where the dosing stand 101 includes three or more wheels, it will be appreciated that the stand may not include separate legs. The dosing stand 101 may further include one or more devices to lock the stand in the working position such as, but not limited to, one or more wheel locks. In another embodiment, the dosing stand 101 is compact to aid portability and/or for ease in interacting with the bottle conveying system. The dosing stand 101 may also include at least one hose rack 108 for supporting an umbilical bundle. The umbilical bundle is used for transporting the dose blend 110 and/or for electrical wiring purposes. The umbilical bundle may be any suitable length including, but not limited to, about ten to thirty feet, according to one embodiment. The fluid transport portion of the umbilical bundle comprises fluid connectors to connect the supply tank system 102 to the recirculation system 103, the recirculation system 103 to the dosing assembly 104, and the dosing assembly 104 to the supply system 102. It will be appreciated that the umbilical bundle may not be contiguous, but instead comprise parts for connecting the separate assemblies/systems.

The mixing-blending-supply tank system 102 includes a supply tank 109 filled with a dose blend 110, a lid 111, at least two sealed ports 112*a*, 112*b*, and a filtered vent 112*c*. In one embodiment, the lid 111 is hinged. The supply tank 109 may be any suitable size required for holding a suitable amount of the dose blend. In embodiments, the supply tank is about a 0.1-25 gallon supply tank. The supply tank is a 10 gallon supply tank, according to one specific, but non-limiting, embodiment. In other embodiments, the supply tank holds about 1-20, about 2-20, about 5-20, about 1-5, about 1-10, about 5-10, about 10-15, or about 10-20 gallons. Suitable supply tanks may be fabricated by Laciny Bros, Inc. (St. Louis, Mo.) or JVNW, Inc. (Canby, Oreg.).

In one non-limiting embodiment, the dose blend 110 is a homogenous suspension of the dose material in a suitable liquid phase. In one non-limiting embodiment, the dose blend 110 comprises colored mica particles in a mixture of alcohol, water and/or citric acid. It will be appreciated that the dose blend 110 may be a suspension of other suspended solids in a mixture of other liquids, according to other embodiments. The dose blend may comprise any liquid or material that would require cleaning between use of a filling system. In particular, the dose blend may be any liquid or material that requires extensive or excessive cleaning to remove the material from a filling system before using the system with a further material. In other embodiments, the dose blend may be any liquid or material that would contaminate a further material used in the filling system. The system will be described hereafter with regard to a suspension of colored mica although it will be appreciated that the description is applicable to any suitable dose blend.

In an embodiment, the supply tank 109 includes a removable and/or hinged lid 111 for adding materials and/or cleaning. The lid 111 further includes at least two sealed ports 112*a* and 112*b* for the discharge and return of the dose blend and a filtered inlet 112*c* to atmosphere or inert gas 110. It will be appreciated that the sealed ports 112*a*, 112*b* and/or filtered inlet 112*c* may be positioned in the supply tank 109 as well as in the lid 111. The supply tank 109 preferably includes an agitator 113. In one embodiment, the agitator 113 has a variable-speed motor (such as an AC-VFD or DC with speed controller) to provide the various speeds preferred for mixing ingredients and/or maintaining a homogenous mixture for extended times and/or for cleaning the system. It will be appreciated that any suitable agitator and/or variable speed motor may be included as part of the tank design and manufacture. In embodiments, the agitator may be one as manufactured by Laciny or JVNW. The VFD motor controls the rotational speed of an alternating current (AC) electric motor by controlling the frequency of the electrical power supplied to the motor. This keeps the dose blend 110 in motion by shaking and/or stirring the supply tank 109 so that the colored mica powder will be continuously and/or homogenously suspended in the dose blend 110. The agitator 113 may include any motor system that maintains the colored mica particles suspended in the dose blend 110.

Figure 3:
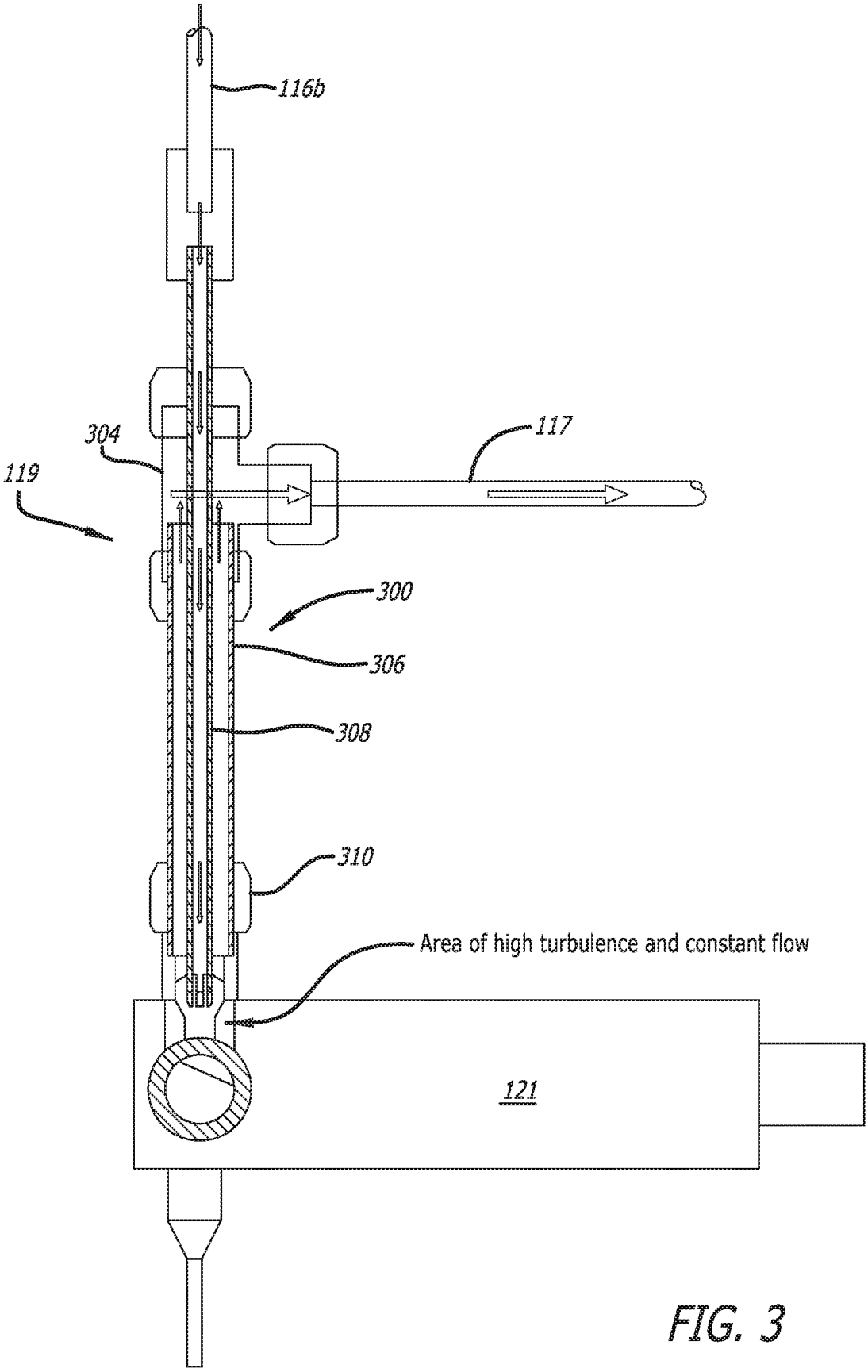
FIG. 3 is a diagram of an exemplary connection assembly for connecting/coupling the supply tube to the dosing pump.

The recirculation assembly 103 includes a pump 114, such as a peristaltic pump, preferably with a variable speed controlled motor. Suitable pumps are available from Watson-Marlow Pumps. A flow assembly may maintain the mixture flow in such a way that the heavy mica particles are kept in suspension with a sufficient mixture velocity. Higher mixture velocity prevents the particles from settling. Sufficient mixture supply pressure is required to the dosing pump infeed to provide consistent dose volumes in each bottle. This is accomplished with designed maximum clearances and minimum flow velocities to direct, regulate and control, and/or maintain the homogenous mixture flow from the supply tank to the portable dosing assembly and back to the supply tank. The hose rack 108 holds at least a portion of the umbilical bundle, according to one embodiment. The umbilical bundle typically includes two sections of dose supply tubes or hoses 116*a* and 116*b*, a dose return tube or hose 117, and a bottle sensor cable 118. The dose supply tube 116*b* is connected to the dosing pump 121 by any suitable means including, but not limited to, a feed screw 119. In another embodiment, the dose supply tube 116*b* is connected to the dosing pump via an assembly of parts 119. Any suitable connection(s) between the second section of the dose supply tube 116*b* and the dosing pump 121 are contemplated. One exemplary connection assembly is shown in FIG. 3. The first section of the dose supply tube 116*a* transports the dose blend 110 from the supply tank 109 to the peristaltic pump 114 and the second section of the dose supply tube 116*b* transports the dose blend 110 from the peristaltic pump 114 to the dosing pump 121. The peristaltic pump 114 draws the dose blend 110 from the supply tank 109 through the first section of the dose supply tube 116*a* and pumps it through the second section of the dose supply tube 116*b* in the direction toward the dosing pump 121 as shown in the flow direction of the dose blend 110 in FIG. 1, according to one embodiment. The peristaltic pump 114 includes a circular pump casing with a rotor. The rotor includes a number of rollers which are attached to the external circumference to relax and compress the flexible tube in the pump casing. When the flexible tube relaxes, the dose blend 110 is drawn from the supply tank 109 through the first section of the dose supply tube 116*a* and moves to the peristaltic pump 114. When the rotor turns, a portion of the flexible tube compresses and closes to push the dose blend 110 out of the peristaltic pump 114 through the second section of the dose supply tube 116*b* in the direction towards the dosing pump 121. The pump 114 may be used to direct, regulate and/or control the flow of the dose blend 110 from the supply tank 109 to the dosing pump 121 and back to the supply tank 109. The recirculation system 103 may make use of plug-in fittings that require no tools, according to one embodiment.

As noted above, the dose supply tube 116*b* may be operatively and/or fluidly connected or coupled to the dosing pump 121 by any suitable coupling or connector. An exemplary connection assembly is shown in FIG. 3. It will be appreciated that this connection assembly is for illustrative purposes only and is not limiting. The dose supply tube 116*b* is connected to the proximal end of a flow tube 300 by a straight fitting 302. In an embodiment, the flow tube 300 comprises an inner flow tube 308 for flow of the dose supply to the dosing pump and an outer flow tube 306 that at least partially covers the inner flow tube 308. An exemplary inner flow tube 308 is a ¼" stainless steel tube and an exemplary outer flow tube 306 is ½" stainless steel tube. It will be appreciated that any suitable size tube may be used for the inner and outer flow tubes. Preferably, the outer flow tube 306 has a circumference that is larger than the inner flow tube 308 to allow flow of the dose blend between the tubes. It will further be appreciated that any suitable material may be used for the inner and outer flow tubes as well as the connectors including, but not limited to carbon steel or other steel alloys, stainless steel, galvanized steel, copper, polyvinyl chloride (PVC) or other polymers. The flow tube 300 is further connected or coupled to the product return tube 117. In an exemplary embodiment, the flow tube 300 is connected or coupled to the product return tube 117 by a T-fitting. An exemplary T-fitting is a heat exchanger T-fitting. The distal end of the flow tube 300 is connected or coupled to the dosing pump 121 through a suitable connector or plug 310. This configuration allows the dose blend to flow into the dosing pump 121 or back to the dose blend supply tank 109. If a bottle is positioned for filling from the dosing pump 121, the dose blend flows from the product supply tube 116*b* through the inner flow tube 308 and into the dosing pump 121. If a bottle is not positioned, or not properly positioned, the dose blend may flow from the product supply tube 116*b* through the inner flow tube 308, into the outer flow tube 306 and to the product return tube 117. The area at the distal end of the inner flow tube 308 is generally an area of high turbulence and constant flow.

The portable dosing assembly 104 preferably includes a mobile stand 120 and a dosing pump 121 fixed on a filler-closure support stand 122. In one embodiment, the mobile stand moves the pre-filled bottles 124 towards the dosing pump 121 after they convey from a filling machine. The dosing system 121 includes a bottle sensor cable 118 and powers a bottle sensor 123 such as a photo eye. One suitable sensor is available from Allen-Bradley. The sensor 123 detects the presence of a bottle opening 125 before the dosing pump 121 injects micro-doses of the dose blend 110 as an existing conveying system advances a pre-filled bottle 124. The pre-filled bottles 124 may be filled to nearly 100% (e.g., 99.5% full), according to one embodiment. It will be appreciated that the bottle may be filled more or less depending on the size of the container and/or the amount of dose blend added. According to one embodiment, the dosing pump 121 may make use of a servo controller that uses error-sensing negative feedback to correct and control the position, speed and/or other parameters so that the correct amount of micro-doses are injected into the bottles 124 (such as with the Hibar P series metering pump). It will be appreciated that any volume of micro-dose may be injected depending on the material injected. As an example, the Hibar P series pump is capable of dispensing 0 ml to about 20 ml. It will further be appreciated that the speed of the conveyer will affect the maximum dose size. A conveyer with a lower speed allows for a larger dose while a conveyer with a higher speed allows for a smaller dose. In non-limiting embodiments, the micro dose comprises about 0.1-5 ml of the dose blend. In further embodiments, the micro dose comprises about 0.5-1 ml, about 0.5-5 ml, or about 1-5 ml of the dose blend. The dosed bottles are conveyed via a feed screw to the closure machine (such as a corker or capper).

The power controls operation assembly 105 includes a power supply 126, a compact logics programmable logic controller (PLC) 127, and/or a human-machine interface (HMI) control panel 128 with an operating and monitoring screen, according to one embodiment. One suitable PLC and HMI control panel may be obtained from Allen Bradley. The power controls operation assembly 105 provides the dosing system 100 with power, electromechanical control and/or a user interface. The PLC 127 provides electromechanical control of the bottle sensor 123 and dosing pump 121 on the assembly line and is generally immune to electronic noise and resistant to vibration and impact. The HMI control panel 128 provides a user interface between the user and the dosing system 100 for controlled operation and monitoring.

Figure 2:
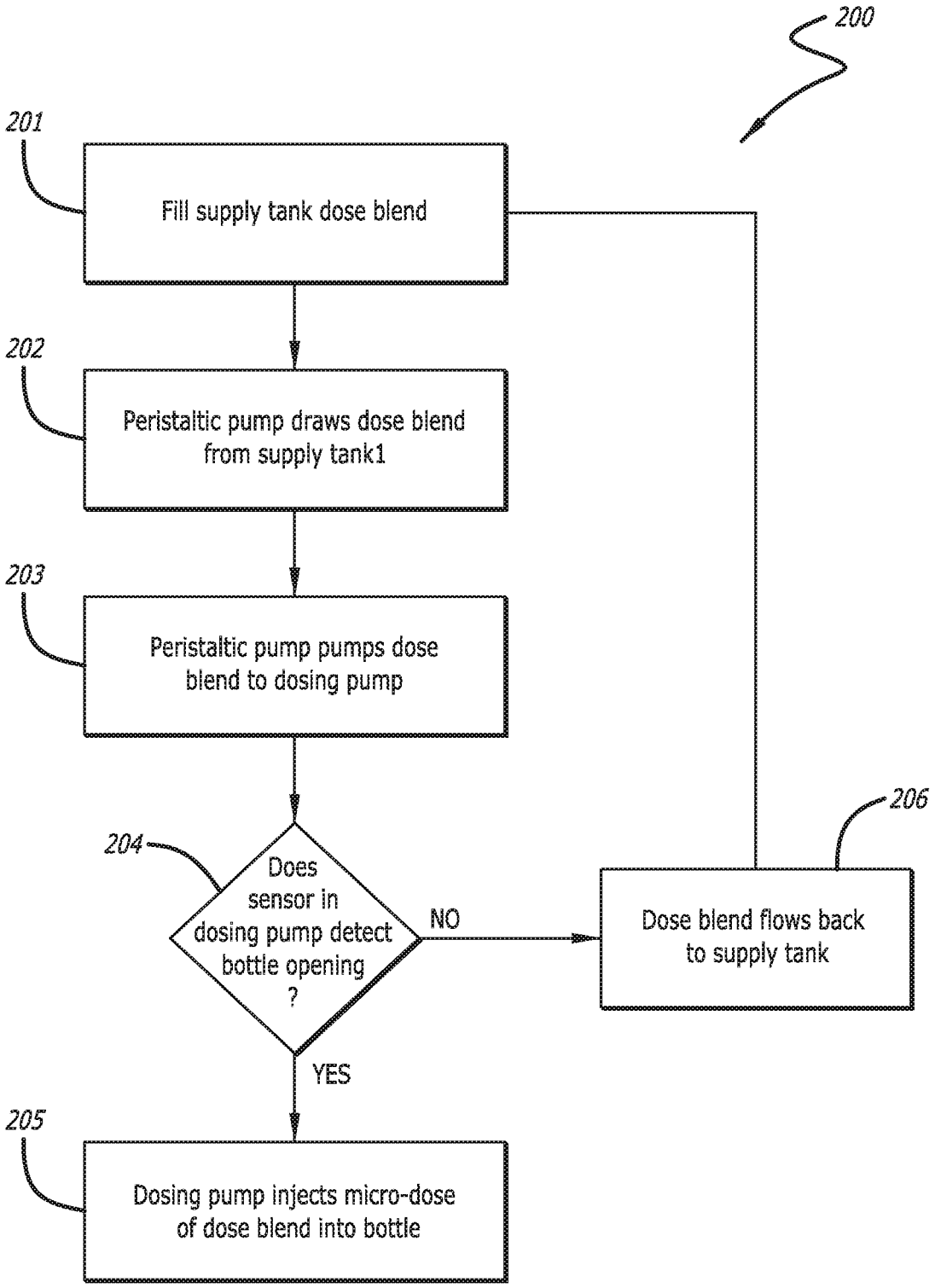
FIG. 2 illustrates an exemplary process for micro-dosing individual bottles of the present system, according to one embodiment.

FIG. 2 further illustrates an exemplary process for micro-dosing individual bottles of the present system, according to one embodiment. A process for micro-dosing individual bottles 200 begins with filling the supply tank with dose blend 201. In one embodiment, the supply tank is filled manually, via measuring implements from bulk drums, buckets, bags and/or tot bins. The peristaltic pump draws the dose blend from the supply tank 202 through the dose supply tube and delivers it to the dosing pump 203. Hence, the dosing pump is filled continuously with the dose blend from the supply tank through a connector 119 such as a uniquely designed group of fittings. After the pre-filled bottles convey through a filling machine, the sensor, which is attached to the dosing pump, determines if a bottle opening is detected 204. If the sensor detects the presence of a bottle opening 204, the dosing pump injects a micro-dose of colored mica into the bottle 205. If a bottle opening is not detected, the dose blend flows through the dose return tube back to the supply tank 206 where the process 200 is repeated. This ensures that there is a continuous flow of the homogenous dose blend from the supply tank to the dosing pump so that the dosing pump injects a micro-dose of dose blend into each individual pre-filled bottle whenever the sensor detects a bottle opening.

Figure 4:
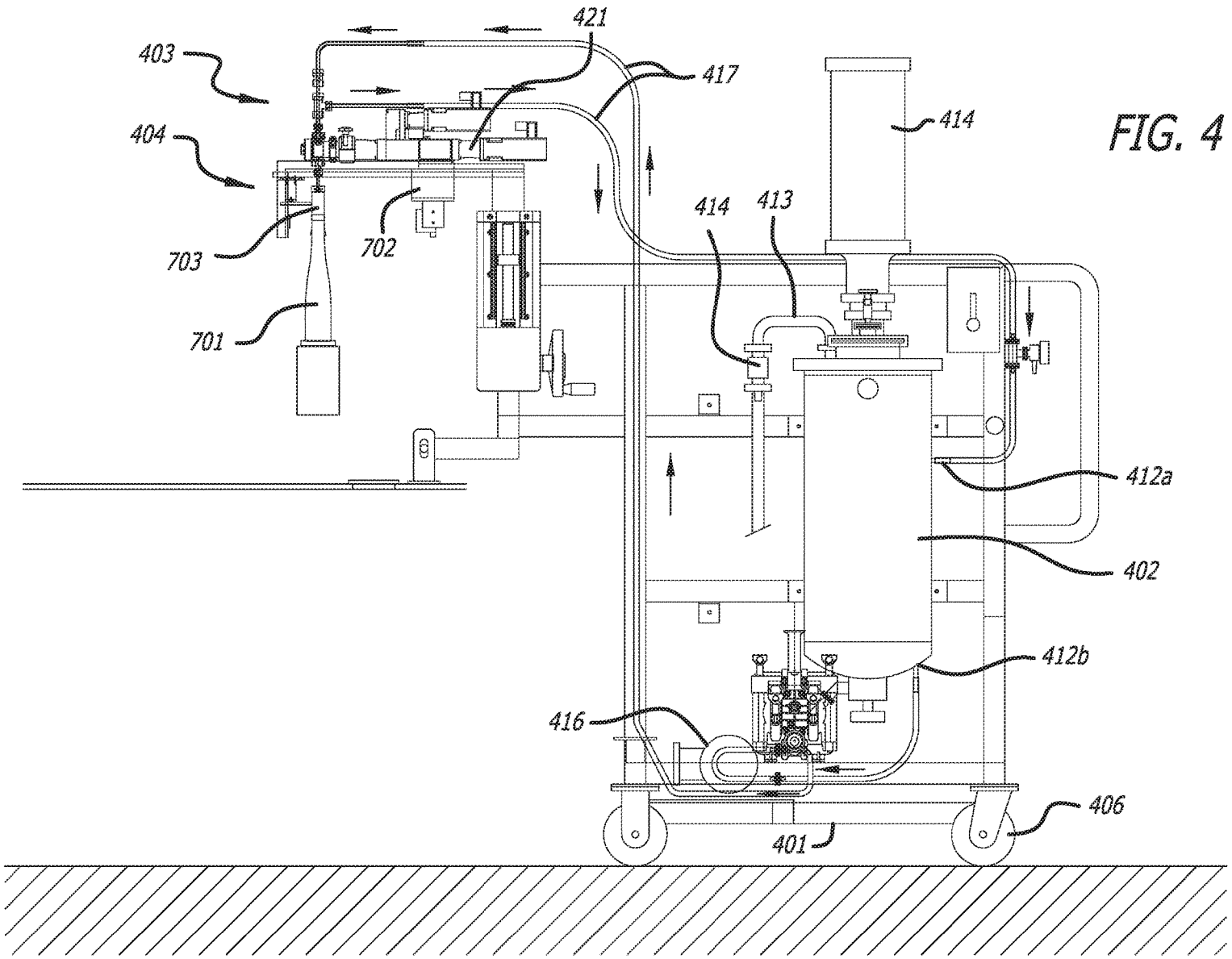
FIG. 4 is a system assembly of a micro bottle dosing system, according to one embodiment.

FIG. 4 illustrates a diagram of a micro bottle dosing system 400, according to one embodiment. The dosing system includes a dosing stand 401, a mixing tank 402, a recirculation assembly 403, a dosing assembly system 404, and a power controls operation system 405. The dosing stand 401 may be a stainless steel stand that is about 39.75 inches wide with a depth of 77.75 inches and a height of 67.75 inches, according to one embodiment. It will be appreciated that the dosing stand 401 may be formed of any suitable material such as, but not limited to, metals and plastics. Suitable metals include, but are not limited to stainless steel, carbon steel or other steel alloys, and titanium. It will be appreciated that the dosing stand may be fabricated of more than one material. It will be further appreciated that the dosing stand 401 may be any size and shape suitable for interacting with a bottle conveying system as known in the art. Preferably, the stand is portable so that it may be used with alternate bottle conveying systems and/or at alternate sites. In this embodiment, the base of the dosing stand 401 includes four wheels 406 for rolling the dosing system 400. The wheels may have locks to secure the stand in the working position. It will be appreciated that the dosing stand 401 may further be positioned on two or more wheels for portability. Where the dosing stand 401 includes two wheels, it will be appreciated that the stand may include separate legs for support. The dosing stand 401 may further include one or more devices to lock the stand in the working position such as, but not limited to, one or more wheel locks. In another embodiment, the dosing stand 401 is compact to aid portability and/or for ease in interacting with the bottle conveying system. The dosing stand 401 may also include at least one hose rack for supporting an umbilical bundle. The umbilical bundle is used for transporting the dose blend 410 and/or for electrical wiring purposes. The umbilical bundle may be any suitable length including, but not limited to, about ten to thirty feet, according to one embodiment. The fluid transport portion of the umbilical bundle comprises fluid connectors to connect the mixing tank 402 to the recirculation system 403, the recirculation assembly 403 to the dosing assembly system 404, and the dosing assembly system 404 to the mixing tank 402. It will be appreciated that the umbilical bundle may not be contiguous, but instead comprise parts for connecting the separate assemblies/systems.

The mixing tank 402 is filled with a dose blend and includes at least two sealed ports 412*a*, 412*b* for connecting hoses. The mixing tank 402 is also connected to a tank flash overflow 413 and a check valve 414. The mixing tank 402 may be any suitable size required for holding a suitable amount of the dose blend. In embodiments, the mixing tank is about a 0.1-25 gallon supply tank. The mixing tank is a 15 gallon tank, according to one specific, but non-limiting, embodiment. In other embodiments, the mixing tank holds about 1-20, about 2-20, about 5-20, about 1-5, about 1-10, about 5-10, about 10-15, or about 10-20 gallons. Suitable tanks may be fabricated by Laciny Bros, Inc. (St. Louis, Mo.) or JVNW, Inc. (Canby, Oreg.).

In one non-limiting embodiment, the dose blend is a homogenous suspension of the dose material in a suitable liquid phase. In one non-limiting embodiment, the dose blend includes colored mica particles in a mixture of alcohol, water and/or citric acid. It will be appreciated that the dose blend may be a suspension of other suspended solids in a mixture of other liquids, according to other embodiments. The dose blend may comprise any liquid or material that would require cleaning between use of a filling system. In particular, the dose blend may be any liquid or material that requires extensive or excessive cleaning to remove the material from a filling system before using the system with a further material. In other embodiments, the dose blend may be any liquid or material that would contaminate a further material used in the filling system. The system will be described hereafter with regard to a suspension of colored mica although it will be appreciated that the description is applicable to any suitable dose blend.

Figure 5:
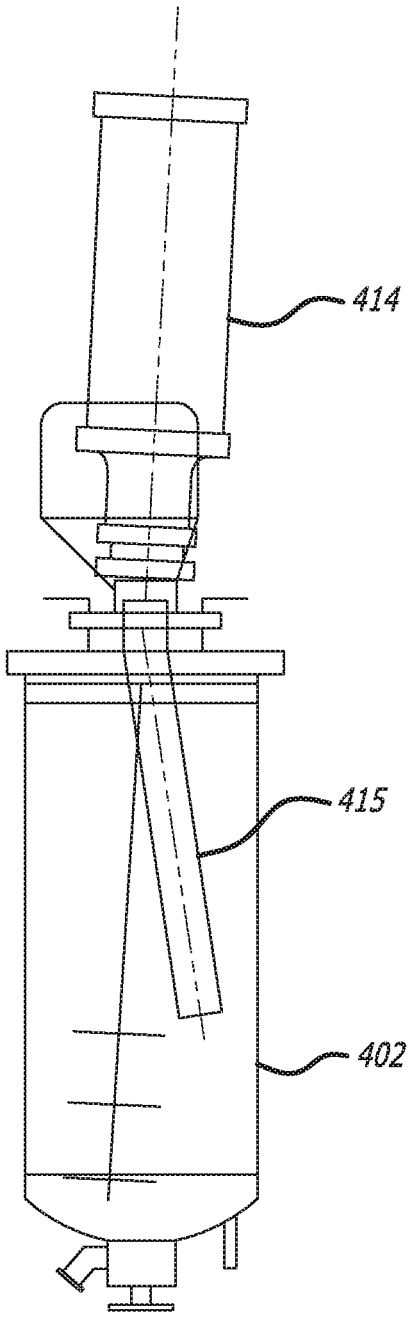
FIG. 5 is a diagram of an exemplary assembly for adding material to the mix tank, according to one embodiment.

As shown in FIGS. 4 and 5, a mixer 414 is attached to the mixing tank 402. In one embodiment, the mixer 414 includes a mixing funnel assembly 415 that extends into the mixing tank 402. The mixing funnel assembly 415 mixes ingredients and/or maintains a homogenous mixture for extended times and/or for cleaning the system. The mixer 414 operates at 350 revolutions per minute and has three impellers mounted on the mixing shaft. It will be appreciated that any suitable agitator and/or variable speed motor may be included as part of the tank design and manufacture. The mixing funnel assembly 415 keeps the dose blend in motion by shaking and/or stirring the mixing tank 402 so that the colored mica powder will be continuously and/or homogenously suspended in the dose blend. The mixing funnel assembly 415 may include any motor system that maintains the colored mica particles suspended in the dose blend.

The recirculation assembly 403 includes a product pump 416, such as a peristaltic pump, preferably with a variable speed controlled motor. Suitable pumps are available from Watson-Marlow Pumps. A flow assembly may maintain the mixture flow in such a way that the heavy mica particles are kept in suspension with a sufficient mixture velocity. Higher mixture velocity prevents the particles from settling. Sufficient mixture supply pressure is required to the dosing pump infeed to provide consistent dose volumes in each bottle. This is accomplished with designed maximum clearances and minimum flow velocities to direct, regulate and control, and/or maintain the homogenous mixture flow from the supply tank to the portable dosing assembly and back to the supply tank.

The system includes a concentrated dose hose 417. The concentrated dose hose 417 is connected to the product pump 416 by any suitable means including, but not limited to, a sanitary compression clamp 601 and hose clamp 601. In another embodiment, the concentrated dose hose 417 is connected to the product pump via an assembly of parts. A first end of the concentrated dose hose 417 transports the dose blend from the mixing tank 402 to the product pump 416 and then the dose blend is transported from the product pump 416 to a servo doser 421. The product pump 416 draws the dose blend from the mixing tank 402 through the first end of the concentration dose hose and pumps it through the hose in the direction toward the servo doser 421 as shown in the flow direction of the dose blend in FIG. 1, according to one embodiment. The product pump 416 may be a peristaltic pump that includes a circular pump casing with a rotor. The rotor includes a number of rollers which are attached to the external circumference to relax and compress the flexible tube in the pump casing. When the flexible tube relaxes, the dose blend is drawn from the mixing tank 402 through the first end of the concentration dose hose 417 and moves to the first pump 416. When the rotor turns, a portion of the flexible tube compresses and closes to push the dose blend out of the first pump through the hose in the direction towards the servo doser 421. The product pump 416 may be used to direct, regulate and/or control the flow of the dose blend from the mixing tank 402 to the servo doser 421 and back to the supply tank 402. The recirculation assembly 403 may make use of plug-in fittings that require no tools, according to one embodiment.

Figure 6:
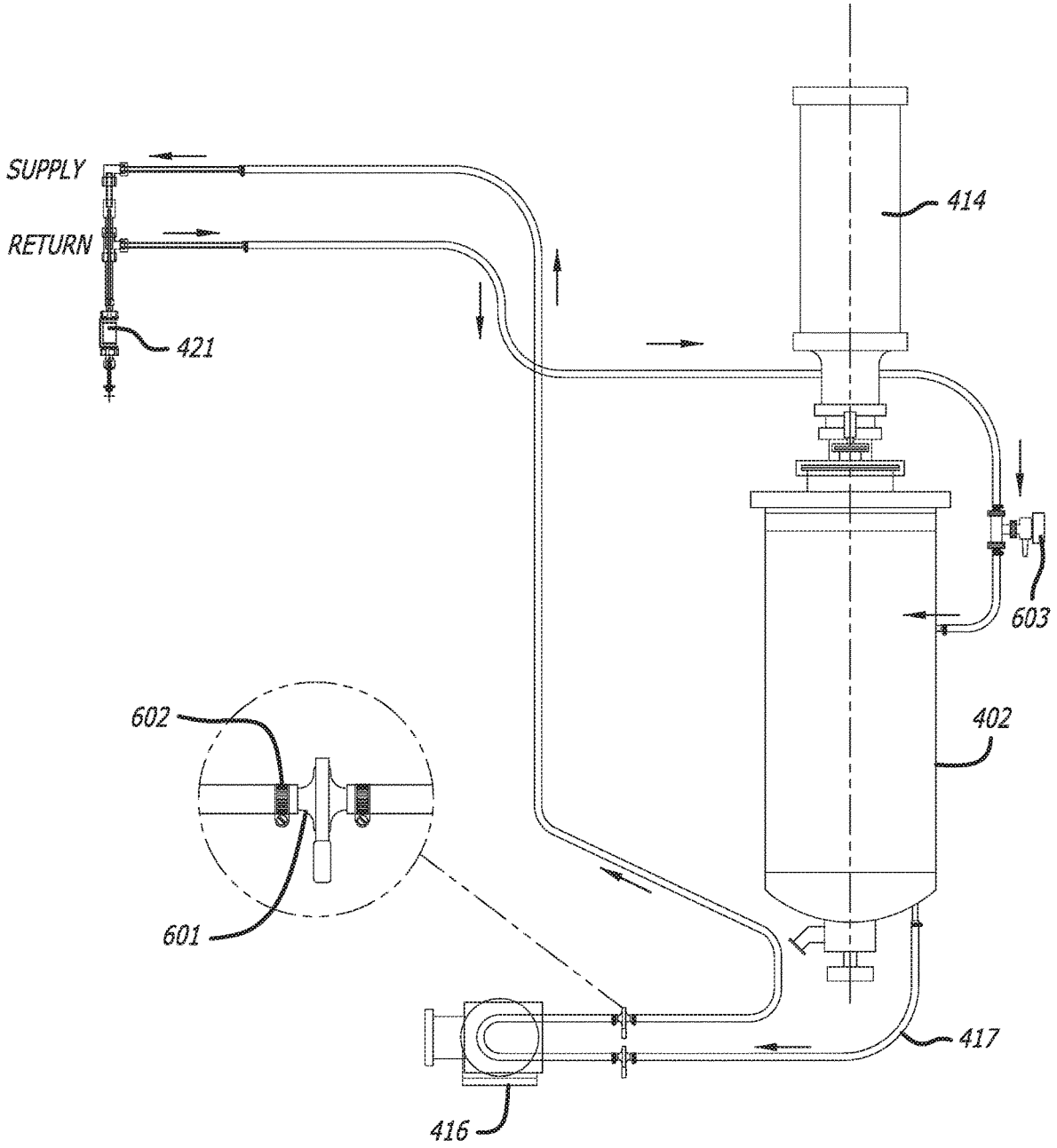
FIG. 6 is a diagram of an exemplary connection assembly for connecting/coupling the supply and return tubing.

As shown in FIG. 6, one embodiment couples the concentration dose hose 417 to the product pump 416 with inlet and discharge sanitary compression clamps 601 (suitable sanitary clamps are available from Alpha Laval, Inc. among others and are commonly referred to as Tri-Clover clamps in the trade). Upon a blockage the sanitary compression clamps 601 may be removed without the use of tools to improve speed of repairs. The section of the concentration dose hose 417 that resides within the peristaltic pump casing 416 is subject to additional wear from the flexing action of the rotor. According to one embodiment spare sections of concentration dose hose 417 with sanitary compression fittings 416 pre-attached are available near the system to further speed repairs.

As noted above, the concentration dose hose 417 may be operatively and/or fluidly connected or coupled to the servo doser 421 by any suitable coupling or connector. An exemplary connection assembly is shown in FIG. 6. It will be appreciated that this connection assembly is for illustrative purposes only and is not limiting.

Figure 7:
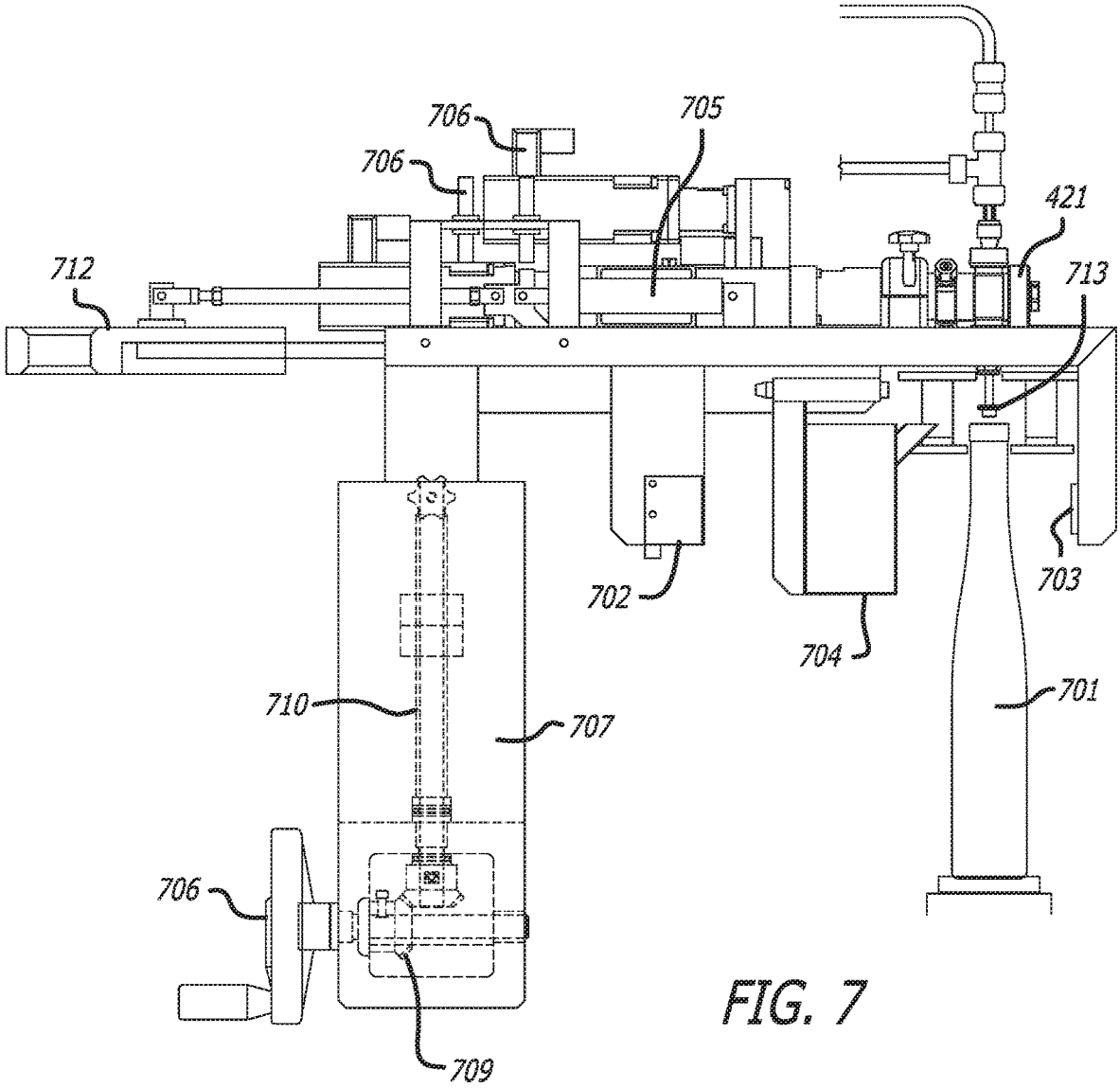
FIG. 7 is a diagram of an exemplary mechanism for adjusting the height of a servo dosing pump on a stand.

In one embodiment, the servo dosing pump 421 is connected to the mobile stand 101 through a height adjust assembly 707 as shown in FIG. 7. The height adjust mechanism allows the servo dosing head distance from the top of the bottle to be adjusted to avoid splash-back and optimize dose timing. The adjustment mechanism utilizes a hand wheel 708 attached to dual miter gears 709. The miter gears cause rotary motion on threaded shaft 710 which in turn raises or lowers threaded bracket 711.

The mobile stand moves a pre-filled bottle 701 towards the servo doser 421 after they convey from a filling machine. The system includes a sensor having a bottle sensor cable 702 and a bottle sensor reflector 703. One suitable sensor is available from Allen-Bradley. The sensor detects the position of a bottle opening before the servo doser 421 injects micro-doses of the dose blend as an existing conveying system advances a pre-filled bottle 701. The pre-filled bottles 701 may be filled to nearly 100% (e.g., 99.5% full), according to one embodiment. It will be appreciated that the bottle may be filled more or less depending on the size of the container and/or the amount of dose blend added. According to one embodiment, the servo doser 421 may make use of a servo controller that uses error-sensing negative feedback to correct and control the position, speed and/or other parameters so that the correct amount of micro-doses are injected into the bottles 701 (such as with the Hibar P series metering pump). It will be appreciated that any volume of micro-dose may be injected depending on the material injected. As an example, the Hibar P series pump is capable of dispensing 0 ml to about 20 ml. It will further be appreciated that the speed of the conveyer will affect the maximum dose size. A conveyer with a lower speed allows for a larger dose while a conveyer with a higher speed allows for a smaller dose. In non-limiting embodiments, the micro dose comprises about 0.1-5 ml of the dose blend. In further embodiments, the micro dose comprises about 0.5-1 ml, about 0.5-5 ml, or about 1-5 ml of the dose blend. The dosed bottles are conveyed via a feed screw to the closure machine (such as a corker or capper).

In one embodiment the nozzle 713 design utilizes a uniform orifice with a diameter of about 0.062 Inch. The selection of nozzle diameter and taper are dependent upon the viscosity of the micro dose blend and the viscosity of the liquid in the dosed bottle. When a dose is delivered a smaller orifice will cause the dose to be delivered at a higher pressure which may aid in preventing back splash in liquids near the viscosity of water. In further embodiments, nozzle orifices of about 0.093, 0.125, 0.156 and 0.187 are used to provide the optimum dose profile.

According to one embodiment, dripping from the nozzle 713 is limited by creating a minimal suck back on the servo dosing pump 416 after the dose is delivered. When the dose is delivered there is period near the end of the delivery where the servo pump is decelerating, near the end of the deceleration the micro dose no longer has sufficient velocity to escape the nozzle and begins to pool on the surface. Once the servo pump has stopped it will reverse slightly to pull this excess material back into the nozzle to prevent a drip.

In one embodiment the dosing head is affixed to a slide assembly 712 as shown in FIG. 7. The slide assembly allows the dosing head to retract through the action of a pneumatic cylinder 705 and position the nozzle over a catch basin 704 during periods of inactivity. While inactive, the material that is in the chamber of the dosing pump may begin to separate therefore the dosing pump will periodically eject a dose into the catch basin. The frequency of the dose ejection in one specific but not limiting embodiment is 15 seconds. The position of the slide assembly may be monitored by proximity sensors 706 to ensure proper location position is achieved.

In operation it may be required to take samples of the dose blend for analysis or inspection. In one embodiment a sanitary sample valve 603 is included in the concentrator dose return line 417 as shown in FIG. 6. The sample valve relieves on the return pressure from the product pump to allow a portion of the return flow to be bled off into a sample container. One such valve is available from Waukesha Cherry-Burrell.

Figure 8:
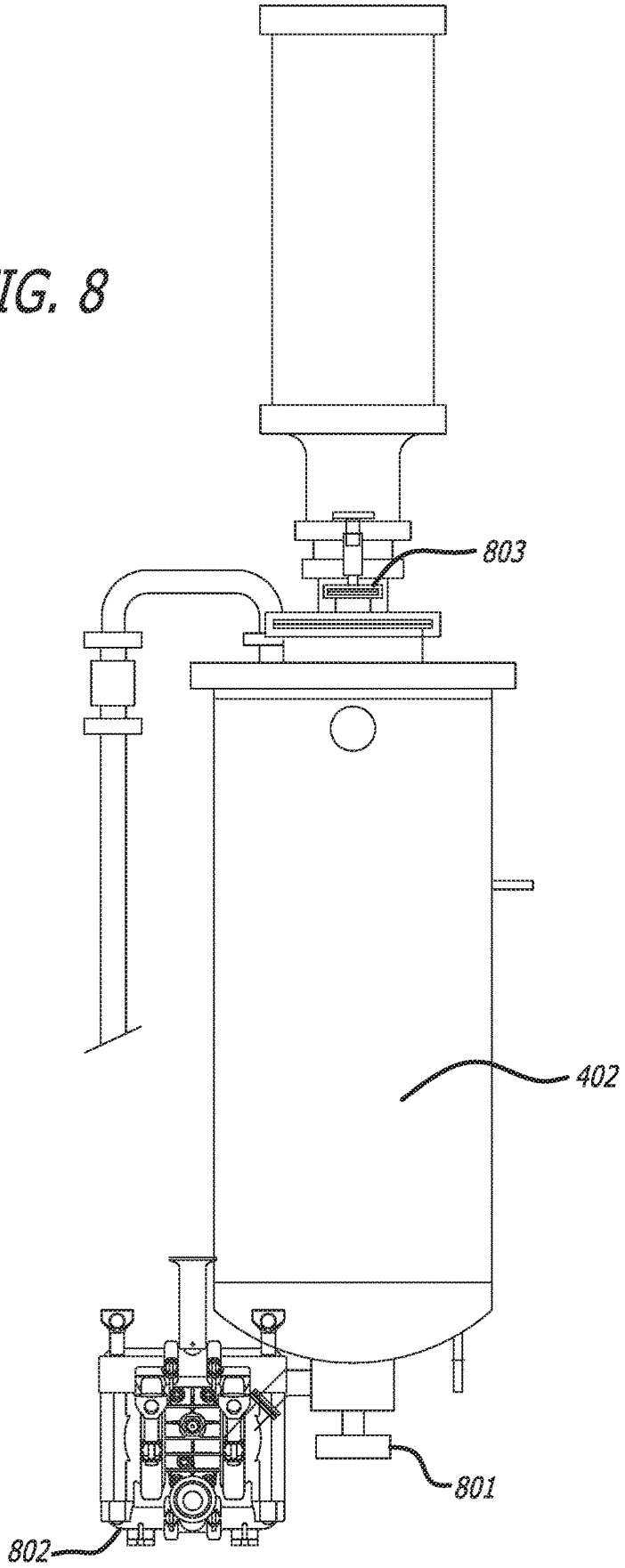
FIG. 8 is a diagram of an exemplary tank having a discharge valve and secondary diaphragm pump.

The tank may contain a sanitary discharge valve 801 and secondary diaphragm pump 802 that is used for evacuating the system after a production run and sanitizing the system as shown in FIG. 8. Suitable sanitary discharge valves are available from ASEPCO and diaphragm pumps are available from Wilden.

Figure 9:
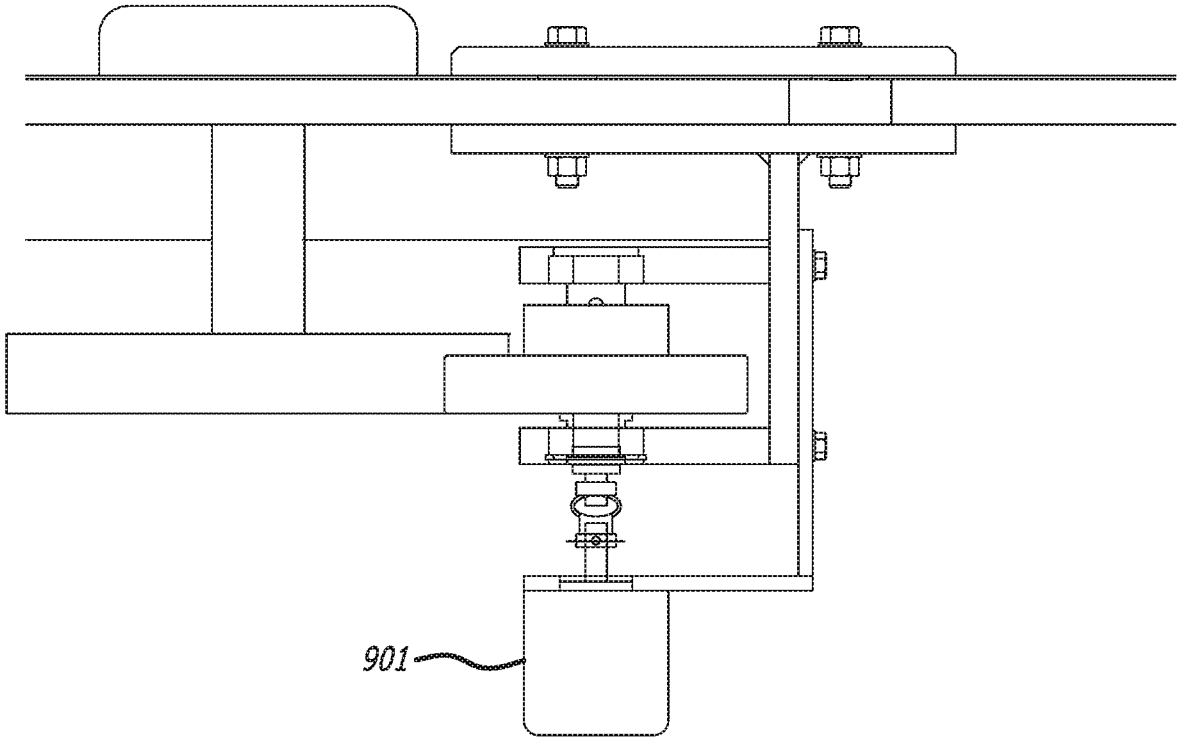
FIG. 9 is a diagram of an exemplary control system having an optical encoder.

In another embodiment an optical encoder 901 may be added to the control system to further enhance the accuracy of the dose delivery within the opening of the bottle as shown in FIG. 9. The optical encoder may be mounted on the feed screw mechanism conveying the bottle through the micro doser. The encoder will provide a precise position of the bottle relative to the dosing servo pump allowing the micro dosing to occur at higher production rates.

According to one embodiment, a process for micro-dosing individual bottles 701 begins with filling the mixing tank 402 with dose blend. In one embodiment, the mixing tank is filled manually, via measuring implements from bulk drums, buckets, bags and/or tot bins. The product pump 416 draws the dose blend from the mixing tank through the concentration dose hose 417 and delivers it to the servo doser 421. Hence, the servo doser is filled continuously with the dose blend from the mixing tank. After the pre-filled bottles convey through a filling machine, the sensor, which is attached to the dosing pump, determines if a bottle is detected. If the sensor detects the presence of a bottle, the dosing pump injects a micro-dose of colored mica into the bottle 701. If a bottle is not detected, the dose blend flows through the dose return tube back to the mixing tank 402 where the process is repeated. This ensures that there is a continuous flow of the homogenous dose blend from the supply tank to the dosing pump so that the dosing pump injects a micro-dose of dose blend into each individual pre-filled bottle whenever the sensor detects a bottle.

The example embodiments have been described herein above regarding the maintaining of suspended colored mica particles in a mixture in a batching mixing-blending-supply tank, supplying the colored mica mixture via a pumped, agitated recirculation system to a dosing pump, which is used to inject micro doses into moving pre-filled bottles after they convey from a filling machine and prior to bottle closure. Various modifications to and departures from the disclosed example embodiments will occur to those having ordinary skill in the art. For example, mixtures with other suspended solids can be supplied to a dosing pump via a pumped, agitated recirculation system.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

We claim:

1. A method, comprising:

maintaining a homogenous suspension in a mixing tank by mixing a solid material in a liquid;

drawing the homogenous suspension from the mixing tank to a product pump;

circulating the homogenous suspension through a hose from the product pump to a servo doser;

detecting a desired position of an opening of a pre-filled vessel;

injecting a desired amount of a micro-dose of the homogenous suspension into the pre-filled vessel with the servo doser; and circulating the homogenous suspension that is not injected back to the mixing tank.

2. The method of claim 1, further comprising agitating the homogenous suspension in the mixing tank with a mixer connected to the mixing tank.

3. The method of claim 2, further comprising controlling a rotational speed of the mixer for agitating the homogenous suspension in the mixing tank.

4. The method of claim 1, wherein drawing the homogenous suspension from the mixing tank to the product pump further comprises adjusting a flow of the homogenous suspension to maintain the solid material in suspension with a desired flow velocity.

5. The method of claim 1, wherein the product pump is a peristaltic pump.

6. The method of claim 1, further comprising detecting the desired position of an opening of the pre-filled vessel using the sensor.

7. The method of claim 1, further comprising injecting the desired amount of the micro-dose of the homogenous suspension through a nozzle having a uniform orifice.

8. The method of claim 7, further comprising creating a low suck back on the servo doser after injecting the micro-dose of the homogenous suspension to the pre-filled vessel.

9. The method of claim 1, wherein injecting the desired amount of the micro-dose of the homogenous suspension into the pre-filled vessel with the servo doser is based on controlling one or more of a position and a speed of the servo doser.

10. The method of claim 9, wherein controlling the one or more of the position and the speed of the servo doser is based on error-sensing negative feedback.

* * * * *